US009021936B2

(12) United States Patent
Roberts

(10) Patent No.: US 9,021,936 B2
(45) Date of Patent: May 5, 2015

(54) VENTLESS ACTUATOR LOCK

(71) Applicant: Eaton Corporation, Cleveland, OH (US)

(72) Inventor: Daniel Henry Roberts, Monrovia, CA (US)

(73) Assignee: Eaton Corporation, Cleveland, OH (US)

( * ) Notice: Subject to any disclaimer, the term of this patent is extended or adjusted under 35 U.S.C. 154(b) by 403 days.

(21) Appl. No.: 13/630,267

(22) Filed: Sep. 28, 2012

(65) Prior Publication Data

US 2014/0090551 A1 Apr. 3, 2014

(51) Int. Cl.
*F15B 15/26* (2006.01)

(52) U.S. Cl.
CPC ..... *F15B 15/261* (2013.01)

(58) Field of Classification Search
USPC ..... 91/41; 92/23, 24, 26, 27, 28
See application file for complete search history.

(56) References Cited

U.S. PATENT DOCUMENTS 5,048,656 A * 9/1991 Braun ..... 92/24
6,786,039 B2 9/2004 Chakkera et al.
7,299,739 B2 * 11/2007 Nakata et al. ..... 91/41

* cited by examiner

*Primary Examiner* — Michael Leslie
(74) *Attorney, Agent, or Firm* — Benesch, Friedlander, Coplan & Aronoff, LLP

(57) ABSTRACT

An actuator includes a cylinder and a piston disposed in the cylinder. The piston has a head and a rod. The actuator further includes a collapsible locking member disposed in the head of the piston, and a gas-filled capsule disposed in the cylinder. The gas-filled capsule is in an expanded position when fluid in the cylinder is below a threshold pressure, and the gas-filled capsule is in a collapsed position when fluid in the cylinder is above the threshold pressure. The actuator also includes a lock piston operably connected to the gas-filled capsule. The lock piston engages the collapsible locking member and biases the collapsible locking member radially outward to a locked position when the gas-filled capsule is in the expanded position.

20 Claims, 2 Drawing Sheets

VENTLESS ACTUATOR LOCK

FIELD OF INVENTION

The present disclosure relates to a locking actuator. More particularly, the present disclosure relates to a ventless lock for a locking hydraulic actuator.

BACKGROUND

Locking hydraulic actuators are known in the art. One example of a locking hydraulic actuator is used in a thrust reverser on an aircraft. Jet engines on many aircraft include thrust reversers to enhance the stopping power of the aircraft. When deployed, thrust reversers redirect the rearward thrust of the jet engine to a forward direction to decelerate the aircraft. When the thrust reversers are no longer needed, they are returned to their original, or stowed, position and are locked in place. Known locking hydraulic actuators include a vent to the atmosphere or to hydraulic tank pressure to regulate pressure required to move an actuator between a locked and unlocked position.

SUMMARY OF THE INVENTION

In one embodiment, a locking, regenerative hydraulic actuator includes a cylinder having a first chamber and a second chamber, and a piston disposed in the cylinder. The piston has a head that separates the first chamber and second chamber of the cylinder. The locking, regenerative hydraulic actuator also includes a collapsible locking member disposed in the head of the piston, biased towards an axis of the cylinder. A ventless, gas-filled capsule is disposed in the first chamber of the cylinder. The ventless, gas-filled capsule has a first position, in which fluid in the first and second chamber is below a threshold pressure, thereby allowing the ventless, gas-filled capsule to expand. The ventless, gas-filled capsule also has a second position, in which fluid in the first and second chamber is above the threshold pressure, thereby collapsing the ventless, gas-filled capsule. The locking, regenerative hydraulic actuator further includes a lock piston operably connected to the ventless, gas-filled capsule, such that when the ventless, gas-filled capsule is in the first position, the lock piston engages the collapsible locking member and biases the collapsible locking member radially outward.

In another embodiment, an actuator includes a cylinder and a piston disposed in the cylinder. The piston has a head and a rod. The actuator further includes a collapsible locking member disposed in the head of the piston, and a gas-filled capsule disposed in the cylinder. The gas-filled capsule is in an expanded position when fluid in the cylinder is below a threshold pressure, and the gas-filled capsule is in a collapsed position when fluid in the cylinder is above the threshold pressure. The actuator also includes a lock piston operably connected to the gas-filled capsule. The lock piston engages the collapsible locking member and biases the collapsible locking member radially outward to a locked position when the gas-filled capsule is in the expanded position.

In yet another embodiment, a device includes a cylinder having an internal shoulder, a first chamber, and a second chamber. Each of the first and second chamber is configured to receive and release a fluid. The device further includes a piston disposed in the cylinder. The piston has a locking member disposed therein, wherein the locking member is biased towards an axis of the piston. A ventless capsule is disposed in the first chamber of the cylinder, wherein the volume of the ventless capsule is determined by fluid pressure in the first chamber and the second chamber, such that when fluid pressure in the first chamber and the second chamber is below a predetermined threshold, the ventless capsule expands and engages the locking member, thereby biasing the locking member to a locked position.

BRIEF DESCRIPTION OF DRAWINGS

In the accompanying drawings, structures are illustrated that, together with the detailed description provided below, describe exemplary embodiments of the claimed invention. Like elements are identified with the same reference numerals. It should be understood that elements shown as a single component may be replaced with multiple components, and elements shown as multiple components may be replaced with a single component. The drawings are not to scale and the proportion of certain elements may be exaggerated for the purpose of illustration.

DETAILED DESCRIPTION

Figure 1:
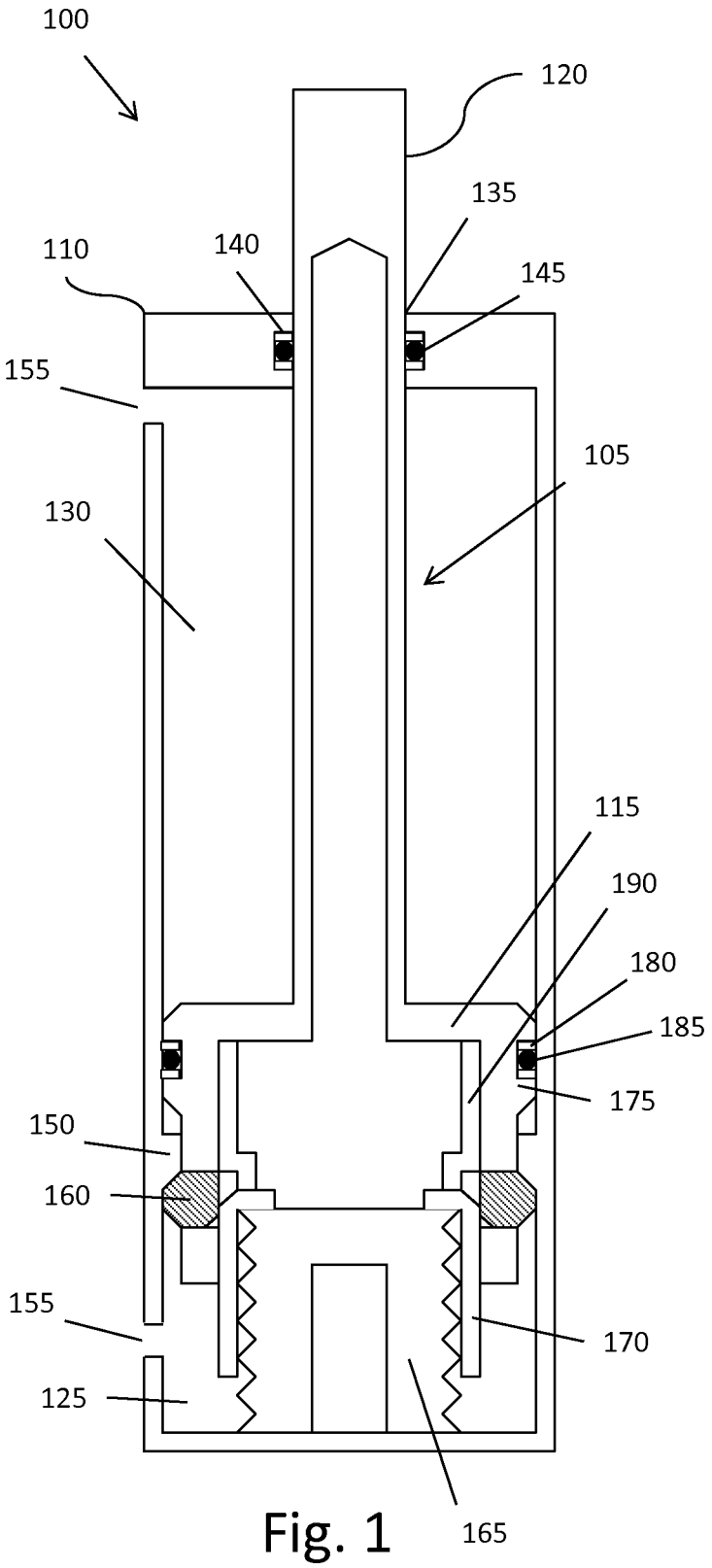
FIG. 1 is a cross section of one embodiment of an actuator in a locked position.
Figure 2:
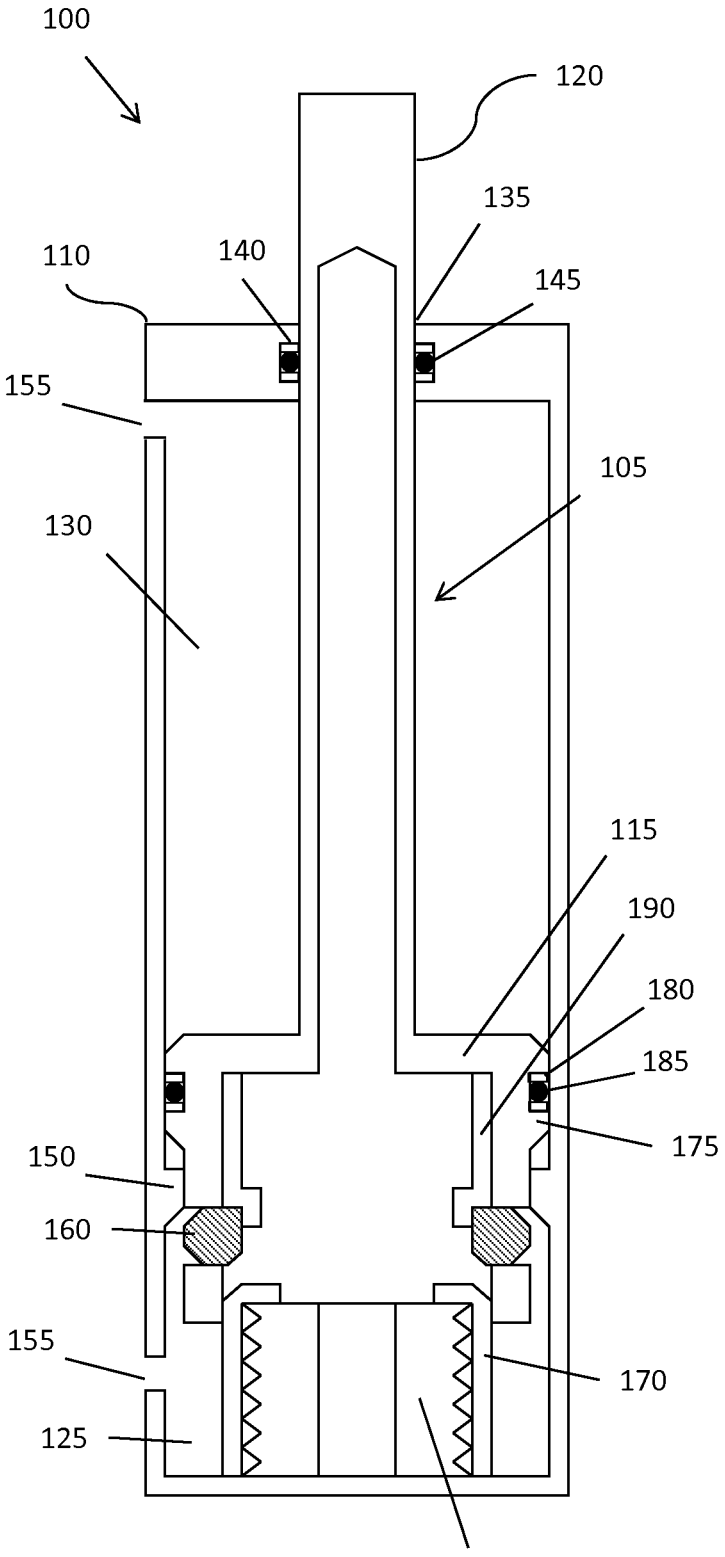
FIG. 2 is cross section of the actuator in an unlocked position.

FIG. 1 illustrates a cross section of an actuator 100 in an unlocked position. FIG. 2 illustrates a cross section of the actuator 100 in a locked position. The actuator 100 will be described with reference to both FIGS. 1 and 2.

In the illustrated embodiment, the actuator 100 is a locking, regenerative hydraulic actuator having a piston 105 and a cylinder 110. A regenerative actuator is one having unequal areas on either side of a piston, where the actuator is supplied with fluid pressure on both sides. Although the pressure on both sides of the piston is the same, the actuator will still extend or retract due to the area difference between the two piston sides. The piston 105 includes a head 115 and a rod 120. The cylinder 110 includes a first chamber 125 and a second chamber 130. The first and second chambers 125,130 are on either side of the piston head, and may therefore change in volume during operation of the actuator 100. The rod 120 of the piston 105 is disposed in the second chamber 130 and extends through an aperture 135 of the cylinder 110. The aperture 130 includes a groove 140 in its sidewall to house an annular seal 145, such as an O-ring. In an alternative embodiment (not shown), the groove and seal may be omitted.

The first chamber 125 may also be referred to as an "extend chamber," pressurising this chamber in isolation will cause the actuator to extend. The second chamber 130 may be referred to as a "retract chamber," because pressurising this chamber in isolation will cause the actuator to retract.

A shoulder 150 is disposed on the internal surface of the cylinder 110. In the illustrated embodiment, the shoulder 150 includes a first side that is normal to the internal surface of the cylinder 110 and a second side disposed at an acute angle relative to the internal surface of the cylinder 110. However, it should be understood that the shoulder may take any shape.

Each of the first and second chambers 125, 130 includes a fluid pathway 155 that leads to an external supply of fluid (not shown). In the illustrated embodiment, the first and second chambers 125, 130 each include a single fluid pathway 155. In an alternative embodiment (not shown), the first and second chambers may include multiple fluid pathways.

A valve (not shown) permits fluid pressure to be applied to the first and second chambers 125, 130 through the fluid pathways 155. In one embodiment, the regulator controls the flow of fluid such that the fluid pressure in the first chamber 125 remains equal to the fluid pressure in the second chamber 130.

In the illustrated embodiment, a collapsible locking member 160 is disposed in the head 115 of the piston 105. The collapsible locking member 160 is biased towards an axis of the cylinder 110. Therefore, the collapsible locking member 160 may also be described as being biased towards an axis of the piston 105. In an alternative embodiment (not shown), the collapsible locking member may be located in the piston rod, instead of the head.

The cylinder 110 also includes a gas-filled capsule 165 disposed in the first chamber 125. In the illustrated embodiment, the capsule 165 is connected to a lock piston 170 configured to engage the collapsible locking member 160. In an alternative embodiment (not shown) the lock piston is omitted, and the capsule itself is configured to engage the collapsible locking member.

The gas-filled capsule 165 does not include any vents, and may therefore be referred to as a ventless, gas-filled capsule 165. Additionally, the ventless, gas-filled capsule 165 is constructed of a non-permeable material, such as steel, inconel, titanium or other material. Therefore, the capsule 165 is configure to retain gas internally, without venting the gas, and the molar quantity of gas inside the capsule 165 remains constant.

The ventless, gas-filled capsule 165 is configured to expand or collapse, according to the fluid pressure in the first and second chambers 125, 130 of the cylinder 110. That is, when the fluid pressure in the first and second chambers 125, 130 increases, the increased pressure will cause the ventless, gas-filled capsule 165 to collapse. Likewise, when the fluid pressure in the first and second chambers 125, 130 decreases, the decreased pressure will allow the ventless, gas-filled capsule 165 to expand In one embodiment, the stroke of the capsule 165 is restricted such that when the fluid pressure in the first and second chambers 125, 130 is above a threshold value the capsule 165 is fully collapsed. The threshold value may be selected according to the required unlocking pressure of the actuator.

FIG. 1 shows the ventless, gas-filled capsule 165 in a first position, in which fluid in the first and second chamber is below a threshold pressure. When the ventless, gas-filled capsule 165 is in the first position, the lock piston 170 engages the collapsible locking member 160, biasing it radially outward. The head 115 of the piston 105 is adjacent the shoulder 150. Therefore, when the locking member 160 is biased radially outward, it abuts or engages the shoulder 150, preventing the piston 105 from extending. The head 115 of the piston 105 also includes a flange 175 that engages the collapsible locking member 160, preventing the piston 105 from moving axially independent of the collapsible locking member 160. Therefore, when the collapsible locking member 160 is biased radially outward, the flange 175, shoulder 150 and the locking member 160 combine to prevent axial movement of the piston 105. Therefore, the piston 105 is in a locked position.

As can be seen in the illustrated embodiment, the flange 175 includes a groove 180 that houses an annular seal 185, such as an O-ring. In an alternative embodiment (not shown), the groove and seal may be omitted.

FIG. 2 shows the ventless, gas-filled capsule 165 in a second position, in which fluid in the first and second chamber 125, 130 is above the threshold pressure. When the ventless, gas-filled capsule 150 is in the second position, the lock piston 170 is disengaged from the collapsible locking member 160, allowing it to collapse such that it no longer abuts the shoulder 150. Because the collapsible locking member 160 does not engage the shoulder 150, the piston 105 may extend and retract in the axial direction. It should be understood that the flange 175 on the head 115 of the piston 105 still prevents the piston 105 from extending beyond a predetermined distance.

A catch 190 is disposed in the head 115 of the piston 105. The catch 190 receives the collapsible locking member 160 when the ventless, gas-filled capsule 150 is in the second position. Accordingly, the catch 190 retains the collapsible locking member 160 in a position where it will be engaged by the lock piston 170 the next time the ventless, gas-filled capsule 150 expands to the first position. In the illustrated embodiment, the lock piston 170 and the collapsible locking member 160 each have angled surfaces, such that the locking member 160 can receive the lock piston 170, and is pushed outward by the lock piston 170 as the capsule 165 expands. In an alternative embodiment (not shown), the lock piston has an angled surface and the collapsible locking member has a straight surface. In another alternative embodiment (not shown), the lock piston has a straight surface and the collapsible locking member has an angled surface. It should also be understood that one or both of the lock piston and collapsible locking member may have a curved surface.

To the extent that the term "includes" or "including" is used in the specification or the claims, it is intended to be inclusive in a manner similar to the term "comprising" as that term is interpreted when employed as a transitional word in a claim. Furthermore, to the extent that the term "or" is employed (e.g., A or B) it is intended to mean "A or B or both." When the applicants intend to indicate "only A or B but not both" then the term "only A or B but not both" will be employed. Thus, use of the term "or" herein is the inclusive, and not the exclusive use. See, Bryan A. Garner, A Dictionary of Modern Legal Usage 624 (2d. Ed. 1995). Also, to the extent that the terms "in" or "into" are used in the specification or the claims, it is intended to additionally mean "on" or "onto." Furthermore, to the extent the term "connect" is used in the specification or claims, it is intended to mean not only "directly connected to," but also "indirectly connected to" such as connected through another component or components.

While the present application has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the application, in its broader aspects, is not limited to the specific details, the representative apparatus and method, and illustrative examples shown and described. Accordingly, departures may be made from such details without departing from the spirit or scope of the applicant's general inventive concept.

What is claimed is:

1. A locking, regenerative hydraulic actuator comprising:

a cylinder having a first chamber and a second chamber;

a piston disposed in the cylinder, having a head that separates the first chamber and second chamber of the cylinder;

a collapsible locking member disposed in the head of the piston, biased towards an axis of the cylinder;

a ventless, gas-filled capsule disposed in the first chamber of the cylinder, wherein the ventless, gas-filled capsule has a first position, in which fluid in the first and second chamber is below a threshold pressure, thereby allowing the ventless, gas-filled capsule to expand, and wherein the ventless, gas-filled capsule has a second position, in which fluid in the first and second chamber is above the threshold pressure, thereby collapsing the ventless, gas-filled capsule; and a lock piston operably connected to the ventless, gas-filled capsule, such that when the ventless, gas-filled capsule is in the first position, the lock piston engages the collapsible locking member and biases the collapsible locking member radially outward.

2. The locking, regenerative hydraulic actuator of claim 1, wherein the piston further includes a rod disposed in the second chamber of the cylinder extending through an aperture of the second chamber of the cylinder.

3. The locking, regenerative hydraulic actuator of claim 1, further comprising an internal shoulder disposed on the cylinder.

4. The locking, regenerative hydraulic actuator of claim 3, wherein when the lock piston biases the collapsible locking member radially outward, the collapsible locking member abuts the internal shoulder of the cylinder.

5. The locking, regenerative hydraulic actuator of claim 4, wherein when the collapsible locking member abuts the internal shoulder of the cylinder, axial movement of the piston is prevented.

6. The locking, regenerative hydraulic actuator of claim 1, wherein when the ventless, gas-filled capsule is in the second position, the lock piston is disengaged from the collapsible locking member.

7. The locking, regenerative hydraulic actuator of claim 6, further comprising a catch disposed in the head of the piston that receives the collapsible locking member when the ventless, gas-filled capsule is in the second position.

8. The locking, regenerative hydraulic actuator of claim 1, further comprising a seal disposed about the head of the piston.

9. An actuator comprising:

a cylinder;

a piston disposed in the cylinder, having a head and a rod;

a collapsible locking member disposed in the head of the piston;

a gas-filled capsule disposed in the cylinder, the gas-filled capsule being in an expanded position when fluid in the cylinder is below a threshold pressure, and the gas-filled capsule further being in a collapsed position when fluid in the cylinder is above the threshold pressure; and a lock piston operably connected to the gas-filled capsule, wherein the lock piston engages the collapsible locking member and biases the collapsible locking member radially outward to a locked position when the gas-filled capsule is in the expanded position.

10. The actuator of claim 9, further comprising a shoulder disposed on an interior surface of the cylinder.

11. The actuator of claim 10, wherein the head of the piston is adjacent the shoulder.

12. The actuator of claim 11, wherein the collapsible locking member is adjacent the shoulder when the collapsible locking member is in the locked position.

13. The actuator of claim 9, wherein the gas-filled capsule is constructed of a non-permeable material.

14. The actuator of claim 13, wherein the gas-filled capsule is configured to retain gas internally without venting gas.

15. A device comprising:

a cylinder having an internal shoulder, a first chamber, and a second chamber, each of the first and second chamber being configured to receive and release a fluid;

a piston disposed in the cylinder, the piston having a locking member disposed therein, wherein the locking member is biased towards an axis of the piston;

a ventless capsule disposed in the first chamber of the cylinder, wherein the volume of the ventless capsule is determined by fluid pressure in the first chamber and the second chamber, such that when fluid pressure in the first chamber and the second chamber is below a predetermined threshold, the ventless capsule expands and engages the locking member, thereby biasing the locking member to a locked position.

16. The device of claim 15, wherein the ventless capsule includes a locking piston disposed thereon.

17. The device of claim 16, wherein the locking piston of the ventless capsule is configured to engage and bias the locking member.

18. The device of claim 15, further comprising an O-ring disposed about a head of the piston.

19. The device of claim 15, wherein the locking member abuts the internal shoulder when the locking member is in the locked position.

20. The device of claim 15, wherein the locking member is disposed in a head of the cylinder.

* * * * *